US007918320B2

(12) United States Patent
Kondo et al.

(10) Patent No.: US 7,918,320 B2
(45) Date of Patent: Apr. 5, 2011

(54) EMERGENCY STOP SYSTEM FOR ELEVATOR

(75) Inventors: Rikio Kondo, Tokyo (JP); Takaharu Ueda, Tokyo (JP); Hiroshi Kigawa, Tokyo (JP); Ken-Ichi Okamoto, Tokyo (JP); Takashi Yumura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 537 days.

(21) Appl. No.: 12/095,025

(22) PCT Filed: Nov. 25, 2005

(86) PCT No.: PCT/JP2005/021710

§ 371 (c)(1),
(2), (4) Date: May 27, 2008

(87) PCT Pub. No.: WO2007/060733

PCT Pub. Date: May 31, 2007

(65) Prior Publication Data

US 2009/0266649 A1 Oct. 29, 2009

(51) Int. Cl.
*B66B 1/32* (2006.01)

(52) U.S. Cl. ..... 187/288; 187/393

(58) Field of Classification Search ..... 187/277, 187/288, 290, 293, 305, 392–393
See application file for complete search history.

(56) References Cited

U.S. PATENT DOCUMENTS

| | | | | |
|---|---|---|---|---|
| 4,750,591 | A * | 6/1988 | Coste et al. | 187/391 |
| 5,360,952 | A * | 11/1994 | Brajczewski et al. | 187/248 |
| 6,173,814 | B1 * | 1/2001 | Herkel et al. | 187/288 |
| 6,196,355 | B1 * | 3/2001 | Fargo et al. | 187/393 |
| 6,516,922 | B2 * | 2/2003 | Shadkin et al. | 187/290 |
| 7,334,665 | B2 * | 2/2008 | Smith et al. | 187/247 |
| 7,350,624 | B2 * | 4/2008 | Deplazes et al. | 187/393 |
| 7,448,471 | B2 * | 11/2008 | Nuebling | 187/286 |
| 7,540,358 | B2 * | 6/2009 | Okamoto et al. | 187/394 |
| 2006/0157305 | A1 * | 7/2006 | DePlazes et al. | 187/391 |
| 2009/0223748 | A1 * | 9/2009 | Mustalahti et al. | 187/254 |
| 2010/0038185 | A1 * | 2/2010 | Kattainen et al. | 187/288 |

FOREIGN PATENT DOCUMENTS

| | | | |
|---|---|---|---|
| GB | 2 153 465 | A | 8/1985 |
| JP | 60-148879 | A | 8/1985 |
| JP | 3-13467 | A | 1/1991 |
| JP | 7-157211 | A | 6/1995 |
| JP | 7-206288 | A | 8/1995 |
| JP | 2002-241062 | A | 8/2002 |

* cited by examiner

*Primary Examiner* — Jonathan Salata
(74) *Attorney, Agent, or Firm* — Leydig, Voit & Mayer, Ltd.

(57) ABSTRACT

An emergency stop system for an elevator includes a state sensor for detecting an operation of a car, a brake device for braking the car, a brake controller for outputting a signal for operating the brake device based on a signal detected by the state sensor, and an uninterruptible power supply device for supplying electric power to the sensor, the brake device, and the controller. The controller has a signal processing/calculating unit for calculating the deceleration of the car based on the signal detected by the sensor, a command value calculating unit for calculating a command value for operating the brake device based on the deceleration of the car calculated by the processing/calculating unit, and a power monitoring device for monitoring state of the uninterruptible power supply device. At least one of the sensor, the processing/calculating unit, and the calculating unit includes independent systems.

13 Claims, 8 Drawing Sheets

EMERGENCY STOP SYSTEM FOR ELEVATOR

TECHNICAL FIELD

The present invention relates to an emergency stop system for an elevator, for braking a car going up and down in a shaft for an emergency stop.

BACKGROUND ART

For a conventional elevator, there has been proposed a method of controlling a braking force of an electromagnetic brake to set a deceleration of a car at an emergency stop to a predetermined value based on a deceleration command and a speed signal (for example, see Patent Document 1). By this method, the elevator can stop at the deceleration neither too high nor too low even at the emergency stop to prevent a human body from being affected by an excessive deceleration. Therefore, even on the end floor, the elevator can stop within an allowable stop distance.

Patent Document 1: JP. 07-157211 A

DISCLOSURE OF THE INVENTION

Problem to be Solved by the Invention

The conventional example has a problem in that the high reliability of a control system or a state sensor is not ensured, and therefore the control system or the state sensor cannot be adapted to a product.

The present invention is devised to solve the problem as described above and has an object to provide an emergency stop system for an elevator, which compares two-or-more-system state sensors and control systems to detect a failure in the control systems or the state sensors without fail to stop braking force control at the occurrence of the failure or to use a normal system, thereby safely braking an elevator even at the occurrence of the failure to cause the elevator to make an emergency stop.

Means for solving the Problem

An emergency stop system for an elevator according to the present invention includes: a state sensor for detecting an operation of a car; a brake device for braking the car; a brake controller for outputting a signal for operating the brake device based on a signal detected by the state sensor; and an uninterruptible power supply device for supplying electric power to the state sensor, the brake device, and the brake controller, in which: the brake controller includes: a signal processing/calculating unit for calculating a deceleration of the car based on the signal detected by the state sensor; a command value calculating unit for calculating a command value for operating the brake device based on the deceleration of the car, which is calculated by the signal processing/calculating unit; and a power monitoring device for monitoring a state of the uninterruptible power supply device; and at least any one of the state sensor, the signal processing/calculating unit, and the command value calculating unit has a plurality of independent systems.

EFFECTS OF THE INVENTION

The emergency stop system for an elevator according to the present invention detects a failure in a control system or a state sensor without fail through the comparison between the results output from multiple detection means and calculation means to stop braking force control or to use a normal system at the occurrence of a failure. As a result, the emergency stop system for an elevator has the effect of safely braking the elevator even at the occurrence of the failure to cause the elevator to make an emergency stop.

BEST MODE FOR CARRYING OUT THE INVENTION

Hereinafter, a first embodiment and a second embodiment of the present invention will be described.

First Embodiment

Figure 1:
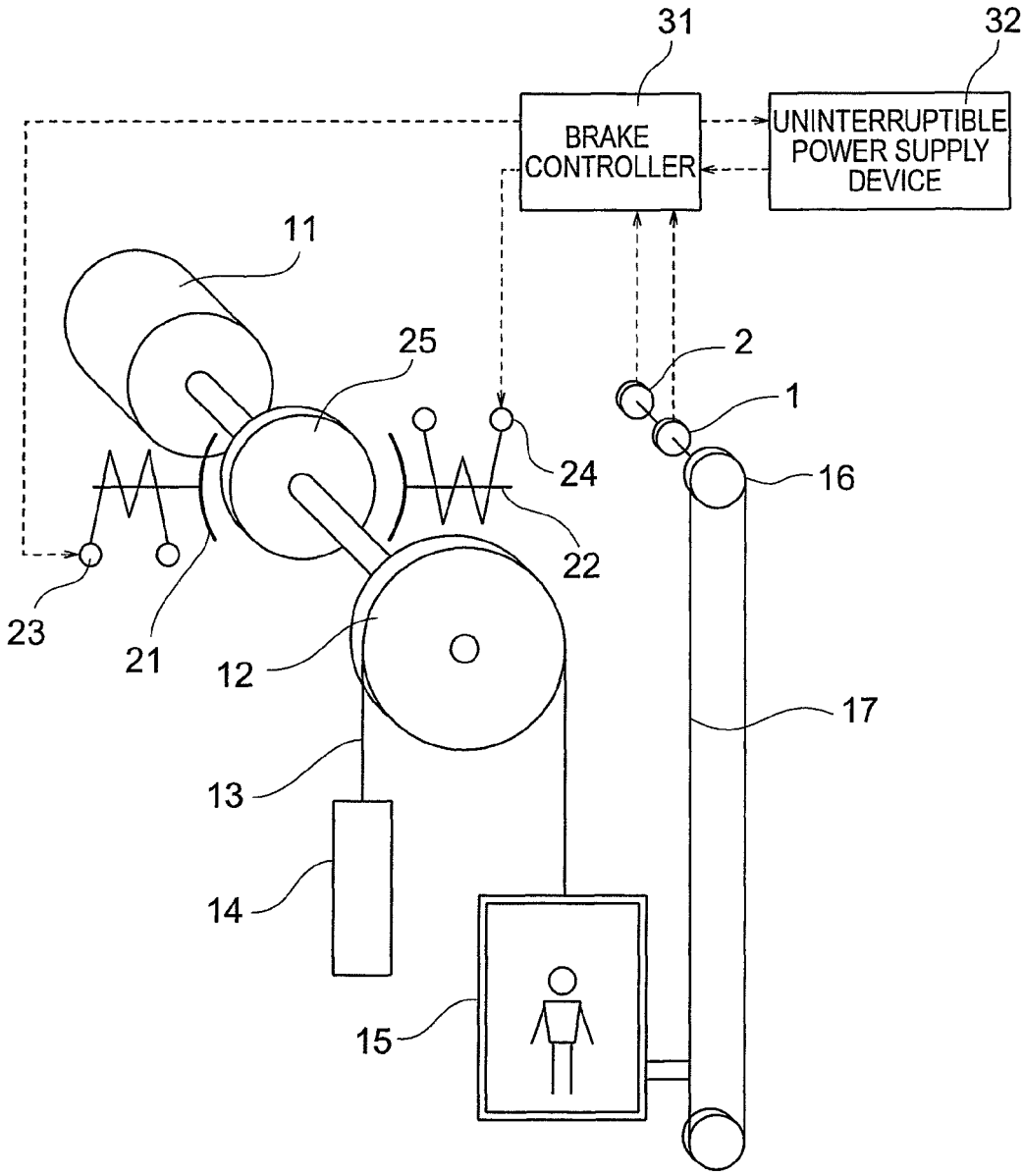
FIG. 1 A view illustrating a configuration of an emergency stop system for an elevator according to a first embodiment of the present invention.

An emergency stop system for an elevator according to the first embodiment of the present invention will be described referring to FIGS. 1 to 4. FIG. 1 is a view illustrating a configuration of the emergency stop system for an elevator according to the first embodiment of the present invention. In each of the drawings, the same reference numeral denotes the same or equivalent part.

In FIG. 1, in an elevator, a main rope 13 which connects a car 15 and a counterweight 14 is looped around a sheave 12. Normally, the sheave 12 is rotated by a hoisting machine 11 to move the main rope 13 and the car 15 and the counterweight 14, which are connected to the main rope 13, by a friction force between the sheave 12 and the main rope 13. A speed governor 16 is a device which pulls up a speed governor rope 17 moving in tandem therewith to operate a safety device to stop the car 15 when the car 15 is lowered at an excessively high speed. During a normal operation, the speed governor 16 rotationally operates in tandem with the movement of the car 15.

Since the emergency stop system for an elevator has an object to control a deceleration, a speed, and a position of the car 15 according to determined target values, the emergency stop system for an elevator includes a state sensor for detecting a deceleration, a speed, or a position of a part moving in tandem with the car 15 or a load applied to the counterweight 14 or the car 15. The emergency stop system for an elevator according to the first embodiment has independent two-system encoders corresponding to a first speed governor encoder (first state sensor) 1 and a second speed governor encoder (second state sensor) 2, and estimates the movement of the car 15 based on the decelerations detected by the speed governor encoders or the like. Signals detected by the two-system speed governor encoders 1 and 2 are input to a brake controller 31.

The brake controller 31 outputs signals for operating the brake to a first brake coil 23 and a second brake coil 24 based on the signals detected by the speed governor encoders 1 and 2. In this first embodiment, a so-called electromagnetic brake is supposed as a brake device. The brake device pushes braking members (first brake plunger 21 and second brake plunger 22) against a member to be braked (brake pulley 25) with an elastic force of an elastic member to brake the member to be braked with a friction force. When the circuits (first brake coil 23 and second brake coil 24) are energized, an electromagnetic force acts on the braking members 21 and 22 in a direction reacting against the elastic force to separate the braking members 21 and 22 from the member to be braked 25. When a power supply from the power source is shut off, the brake device brakes the car 15 with the maximum braking force.

Figure 2:
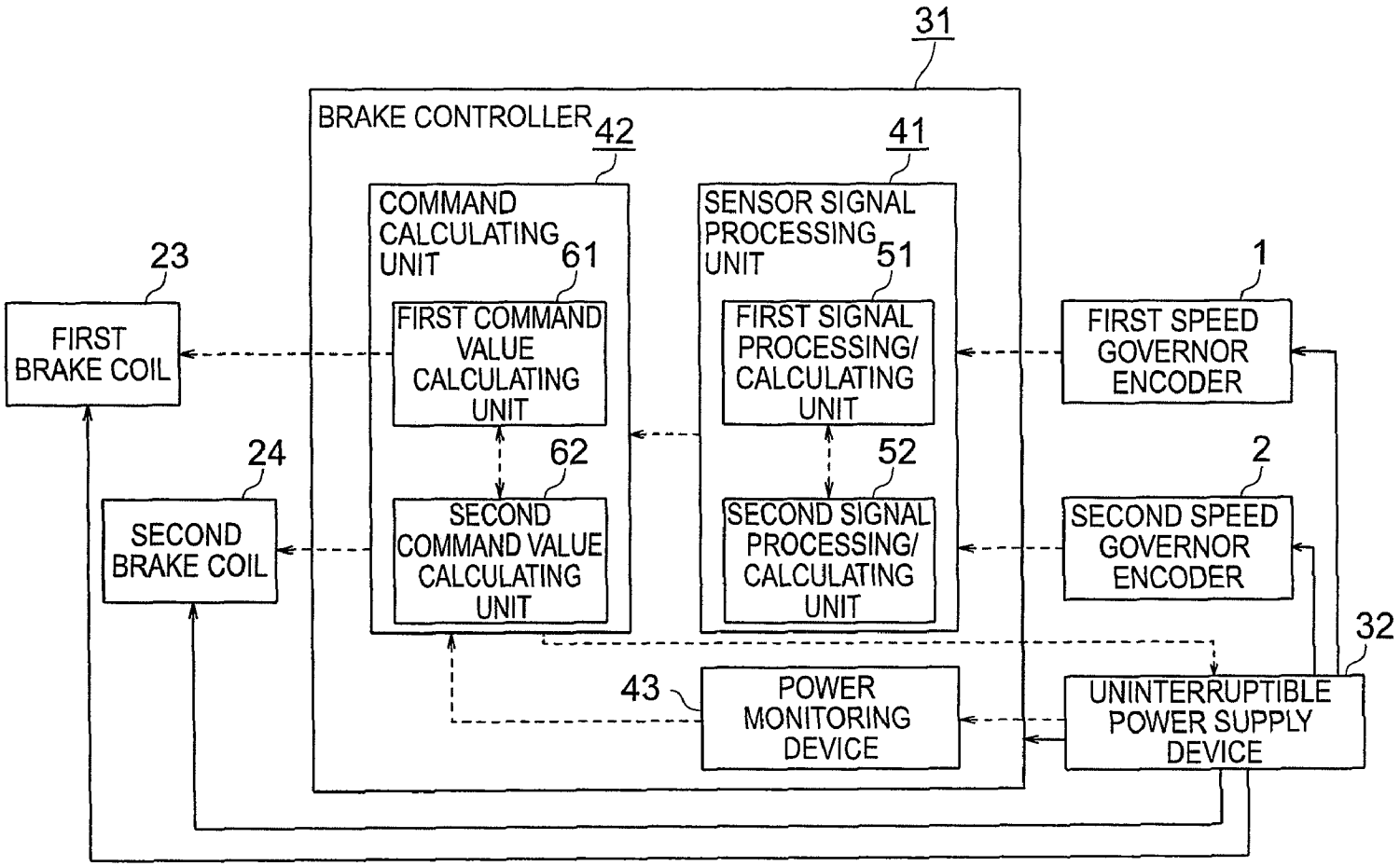
FIG. 2 A block diagram illustrating a configuration of a brake controller of FIG. 1.

FIG. 2 illustrates an example showing a configuration of the brake controller 31 of FIG. 1. The brake controller 31 includes a sensor signal processing unit 41 for processing the signals received from the speed governor encoders 1 and 2, a command calculating unit 42 for calculating command values based on the processed sensor signals to output the calculated command values to the brake coils 23 and 24, and a power monitoring device 43 for monitoring a state of an uninterruptible power supply device 32 to output a command according to the monitored state. In the drawing, each dotted arrow indicates the transfer of the signal, whereas each solid arrow indicates the power supply.

Figure 3:
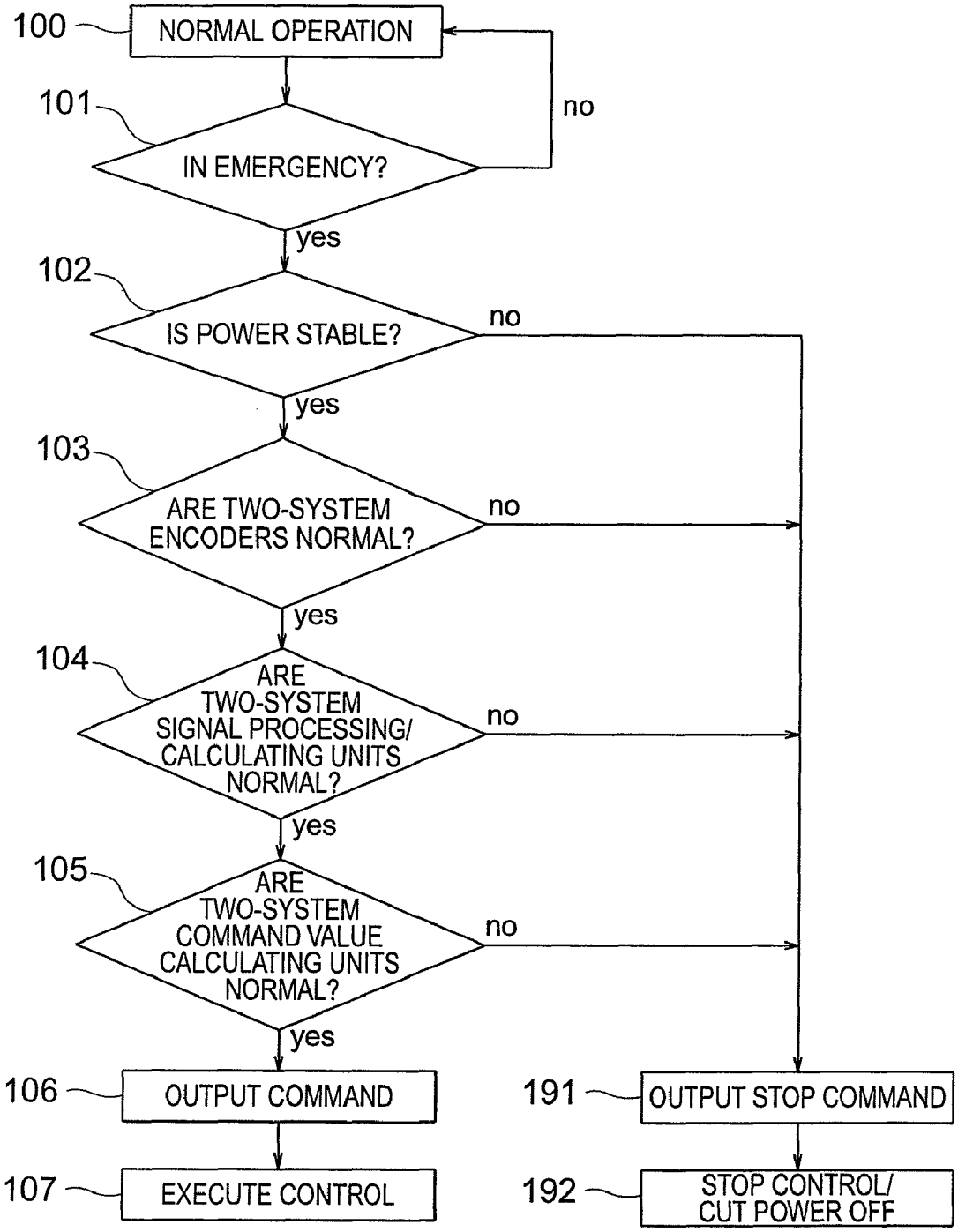
FIG. 3 A flowchart illustrating an operation of the brake controller of FIG. 1.

Next, an operation of the emergency stop system for an elevator according to this first embodiment will be described referring to the drawings. FIG. 3 is a flowchart illustrating an operation of the brake controller of the emergency stop system for an elevator according to the first embodiment of the present invention.

The brake controller 31 receives an emergency stop command signal from an elevator operating device such as a control board to start the operation based on the received signal (Step 101).

The power monitoring device 43 monitors a state of electric power supplied from the uninterruptible power supply device 32 to the entire brake control system. When the supplied electric power is unstable, the power monitoring device 43 feeds a power fail signal for stopping the brake control to the command calculating unit 42 (Step 102).

The sensor signal processing unit 41 calculates deceleration of the car based on the signals detected by the first speed governor encoder 1 and the second speed governor encoder 2. The sensor signal processing unit 41 has two-system signal processing/calculating units corresponding to a first signal processing/calculating unit 51 and a second signal processing/calculating unit 52, each independently performing a calculation. First, each of the signal processing/calculating units 51 and 52 calculates a state quantity of the elevator, such as the deceleration based on the signals obtained from the speed governor encoders 1 and 2. The results are compared in each of the calculating units to detect a malfunction of the encoder. For example, when a difference between the state quantity calculated by the two-system encoders 1 and 2 the state quantity calculated by the two-system encoder 2 is smaller than a predetermined value in the first signal processing/calculating unit 51, or is less than the predetermined value (first predetermined value), it can be determined that the both encoders 1 and 2 operate normally. When the difference is larger than the predetermined value, or is equal to or larger than the predetermined value (first predetermined value), it can be determined that at least one of the encoders malfunctions (Step 103). The same process is performed in the second signal processing/calculating unit 52.

Next, when each of the encoders 1 and 2 operates normally, the state quantities of the elevator, which are calculated by the signal processing/calculating units 51 and 52, respectively, are compared with each other to determine that the calculations are correct. The first signal processing/calculating unit 51 calculates the state quantities of the elevator, such as the decelerations based on the signals obtained from the speed governor encoders 1 and 2 to compare an average value of the state quantities with an average value of the state quantities of the elevator, which are calculated by the second signal processing/calculating unit 52. Similarly, the second signal processing/calculating unit 52 calculates the state quantities of the elevator, such as the decelerations based on the signals obtained from the speed governor encoders 1 and 2 to compare an average value of the state quantities with an average value of the state quantities of the elevator, which are calculated by the first signal processing/calculating unit 51. Even in this case, when a difference between the state quantities calculated by the two-system signal processing/calculating units 51 and 52 is smaller than a predetermined value, or is less than the predetermined value (second predetermined value), it can be determined that the signal processing/calculating units 51 and 52 both operate normally. When the difference is larger than the predetermined value, or is equal to or larger than the predetermined value (second predetermined value), it can be determined that at least one of the signal processing/calculating units malfunctions (Step 104).

When it is determined that the speed governor encoders 1 and 2 and the signal processing/calculating units 51 and 52 all operate normally, the sensor signal processing unit 41 outputs, for example, the average value of the state quantities of the elevator, which are calculated by the first signal processing/calculating unit 41 and the second signal processing/calculating unit 52, respectively, to the command calculating unit 42. Processing of obtaining the average value in a plurality of systems is the same in the other processing or in a second embodiment. It should be noted that in some cases, any one of the state quantities of the elevator, which are calculated by the first signal processing/calculating unit 51 and the second signal processing/calculating unit 52, respectively, may be output to the command calculating unit 42. The same is applied to the other processing or the second embodiment. When it is determined that any of the speed governor encoders 1 and 2 and the signal processing/calculating units 51 and 52 does not operate normally, the sensor signal processing unit 41 feeds a detection fail signal for stopping the brake control to the command calculating unit 42.

Next, the command calculating unit 42 calculates a command value for operating the brake and gives commands to the brake and the power source. The command calculating unit has two-system command value calculating units corresponding to a first command value calculating unit 61 and a second command value calculating unit 62, each independently calculating the command value to be provided for the brake. If the detection fail signal or the power fail signal is not input to the command calculating unit 42, the command values each are calculated by the command value calculating units 61 and 62 based on the state qualities of the elevator. The command values calculated by the two command value calculating units are compared with each other to determine that the calculations in the command value calculating units are correct. Even in this case, as being performed in the signal processing/calculating units, when a difference between the state quantities calculated by the two-system command value calculating units 61 and 62 is smaller than a predetermined value, or is less than the predetermined value (third predetermined value), it is determined that the command value calculating units both operate normally to calculate the command values normally. When the difference is larger than the predetermined value, or is equal to or larger than the predetermined value (third predetermined value), it is determined that at least anyone of the command value calculating units malfunctions to prevent the command values from being normally calculated (Step 105).

When it is determined that the command value calculating units 61 and 62 operate normally, an average value of the each calculated brake operation commands is fed from the brake controller 31 to the brake device (Steps 106 and 107). In this case, the brake device is required to be controlled after the determination of a target value which can realize a deceleration which does not adversely affect a passenger in the car 15 and the elevator system, and when the brake controller 31 has information of the position of the car, is moderated within the range that avoids the car 15 from entering the end of a shaft.

When it is determined that the command value is not calculated normally or the detection fail signal or the power fail signal is input, the brake coils 23 and 24 are de-energized. Further, a signal for stopping power feeding from the uninterruptible power supply device 32 is output to the uninterruptible power supply device 32 to shut off the power supply itself. As a result, it can be ensured that the car is prevented from entering the end of the shaft at a dangerous speed.

The uninterruptible power supply device 32 can supply electric power even in an emergency and has power storage ability. When a normal power source is not available, the stored power is supplied. Moreover, if it is determined that the stored power is always used in an emergency, the amount of power supply for keeping the brake in a released state is limited. As a result, since the upper limit of a time period, in which the brake is in the released state, can be ensured, added safety is ensured.

In addition, as a method of further enhancing the safety of the emergency stop system for an elevator, the following methods are conceived. In one method, the brake controller 31 has a timer function. After an elapse of a given period of time, or when the deceleration after an elapse of a given period of time is smaller than a predetermined value, a brake command is output. In another method, the brake command is output when a speed becomes excessively high. In this case, as a cycle used for the timer function, the use of a clock cycle of a CPU or a quartz frequency is given.

In this first embodiment, the brake coils 23 and 24 are de-energized or the power supply from the uninterruptible power supply device 32 is shut off based on the output signal from the command calculating unit 42. When a problem is detected in the power monitoring device 43 or the sensor signal processing unit 41, a command may be directly output from the power monitoring device 43 or the sensor signal processing unit 41 to effect de-energization or to shut off the power supply.

The signals obtained by detecting the rotations of the speed governor 16 with the encoders 1 and 2 are used to calculate the deceleration of the car 15, but a signal obtained by detecting, with a sensor, another part moving in tandem with the car 15, for example, the amount of rotation of the sheave 12, the amount of feeding of the main rope 13, or the amount of upward/downward movement of the counterweight 14 or the car 15 illustrated in FIG. 1 may be used. Alternatively, a signal obtained by detecting a current or a voltage of a motor serving as a source of power with a sensor may be used. Independent two-or-more-system state sensors may be the combination of sensors in different forms (for example, speed governor encoder, hoisting machine encoder, car acceleration sensor, car position sensor and the like). The sensor has different characteristics in control depending on the position of detection. For example, when the sensor directly detects the movement of the car 15, the control for restraining the oscillation of the car 15 can be performed.

The electromagnetic brake is supposed as the brake used for braking in this first embodiment, but other brakes such as a hydraulic brake may be used as long as the brake can change a torque.

For calculating the command value in the command calculating unit 42, so-called PID control for calculating the command value from a proportional element, a time integration element, and a time differentiation element of a difference between the target value and the detected value may be used. Moreover, in the case where the value to be detected is the deceleration, there may be used a method of giving a command to reduce the braking force when the detected value is larger than the target deceleration and giving a command to increase the braking force when the detected value is smaller than the target deceleration. In the former case, highly accurate deceleration control can be expected according to the system. Since two command values are provided and only the switching between the two command values enables the highly-accurate deceleration control in the latter case, the latter case has an advantage in that the configuration is not complicated.

The case where the two-system state sensors or calculating units are prepared and the results are compared to ensure the reliability has been described in the first embodiment. However, a one-system state sensor or calculating unit is provided if the reliability of the safety system is ensured only with the one-system state sensor or calculating unit. Accordingly, the cost can be reduced.

Figure 4:
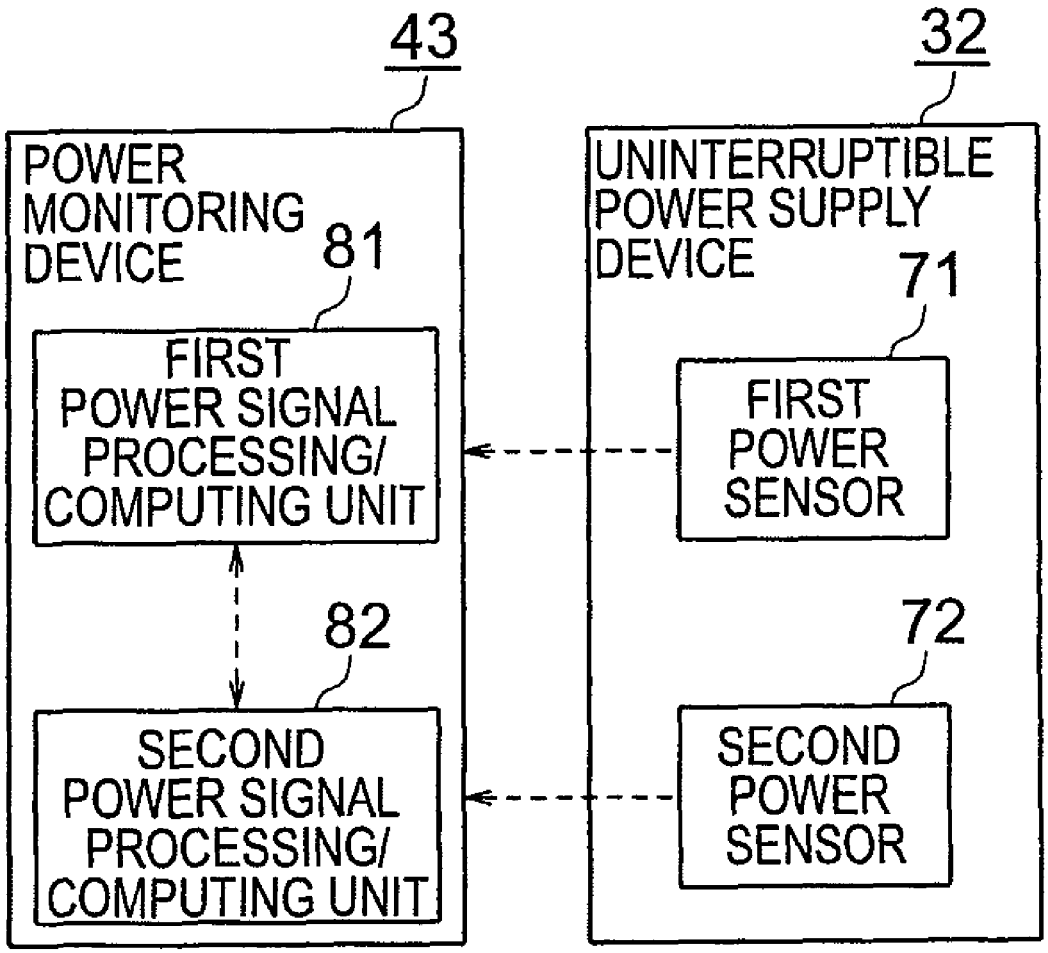
FIG. 4 A block diagram illustrating configurations of an uninterruptible power supply device and a power monitoring device of FIG. 2.

If the uninterrupted power source unit 32 includes independent two-system power sensors 71 and 72 and the power monitoring device 43 includes independent two-system power signal processing/calculating units 81 and 82 as illustrated in FIG. 4 and processing in the power monitoring device 43 is executed in the same sequence (in the same steps as Steps 103 and 104 of FIG. 3) as the sequence of the processing in the sensor signal processing unit 41, the detection of the stability of the power source can be ensured.

Second Embodiment

Figure 5:
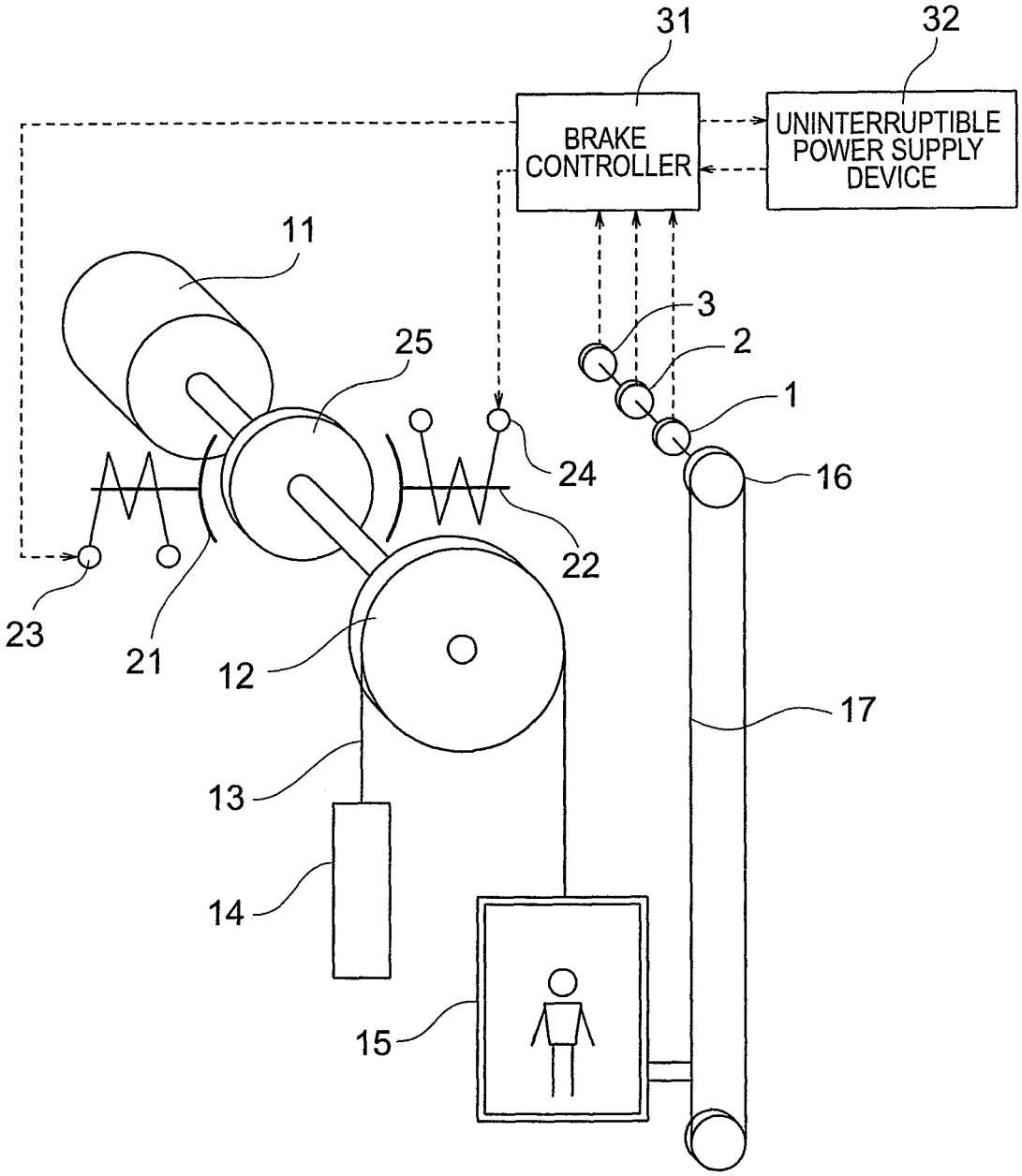
FIG. 5 A view illustrating a configuration of an emergency stop system for an elevator according to a second embodiment of the present invention.

An emergency stop system for an elevator according to the second embodiment of the present invention will be described referring to FIGS. 5 to 8. FIG. 5 is a view illustrating a configuration of the emergency stop system for an elevator according to the second embodiment of the present invention.

In FIG. 5, the configuration of the emergency stop system for an elevator is obtained by adding a third speed governor encoder 3 to the configuration of the first embodiment described above.

Figure 6:
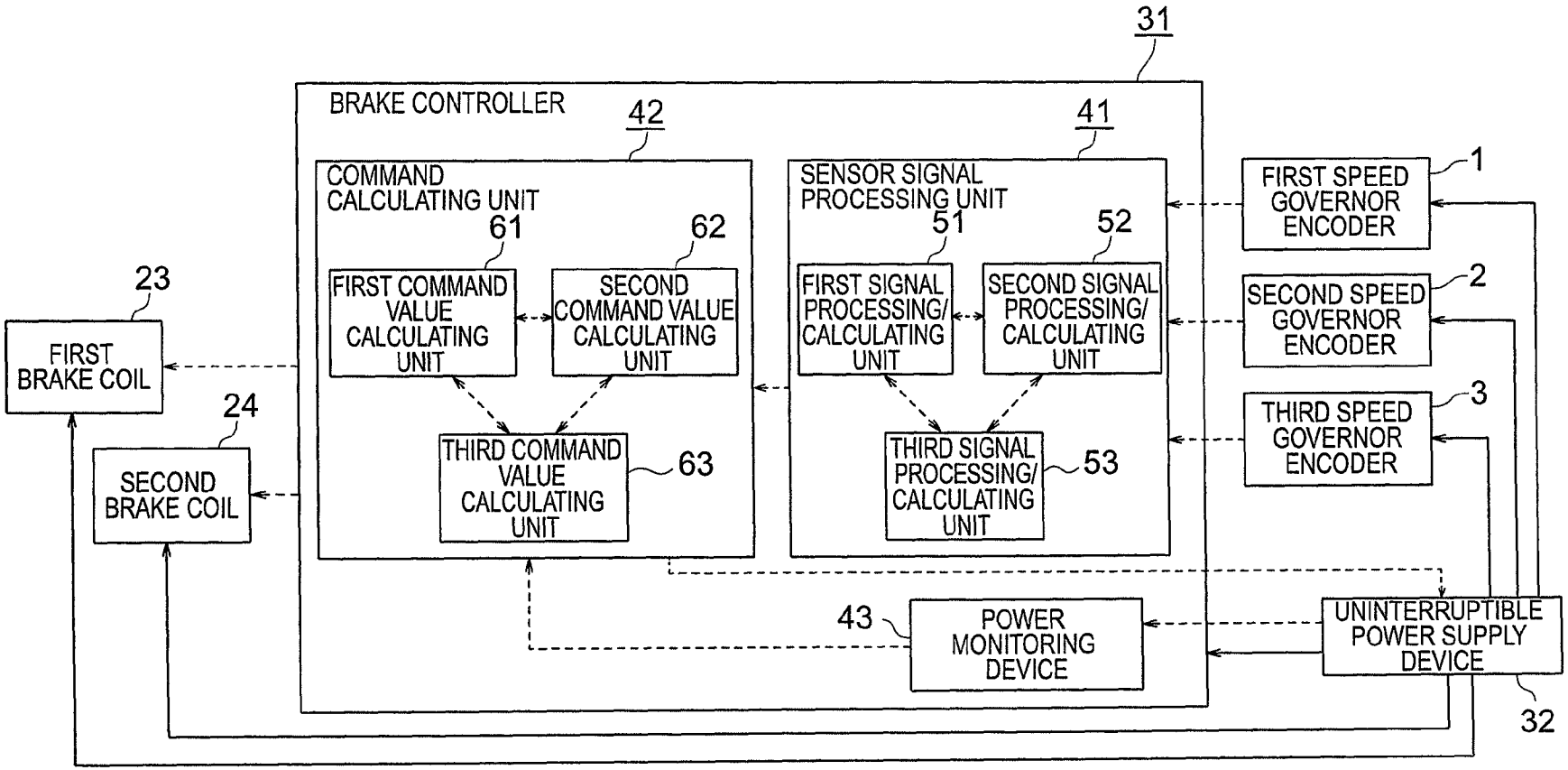
FIG. 6 A block diagram illustrating a configuration of the brake controller of FIG. 5.

FIG. 6 is a block diagram illustrating the configuration of the brake controller of the emergency stop system for an elevator according to the second embodiment of the present invention. The role of the brake controller 31 is to control the braking force of the brake, which is the same as that in the first embodiment. The brake controller 31 includes the sensor signal processing unit 41 for processing the signals received from the first speed governor encoder 1, the second speed governor encoder 2, and the third speed governor encoder 3, the command calculating unit 42 for calculating and outputting the command value based on the processed sensor signals, and the power monitoring device 43 for monitoring the state of the uninterrupted power source unit 32 to output a command according to the monitored state. In FIG. 6, each dotted arrow indicates the transfer of a signal, whereas each solid arrow indicates the power supply. This second embodiment is characterized in that a third signal processing/calculating unit 53 is provided in the sensor signal processing unit 41 and a third command value calculating unit 63 is provided in the command calculating unit 42 in addition to the configuration in the first embodiment described above.

Figure 7:
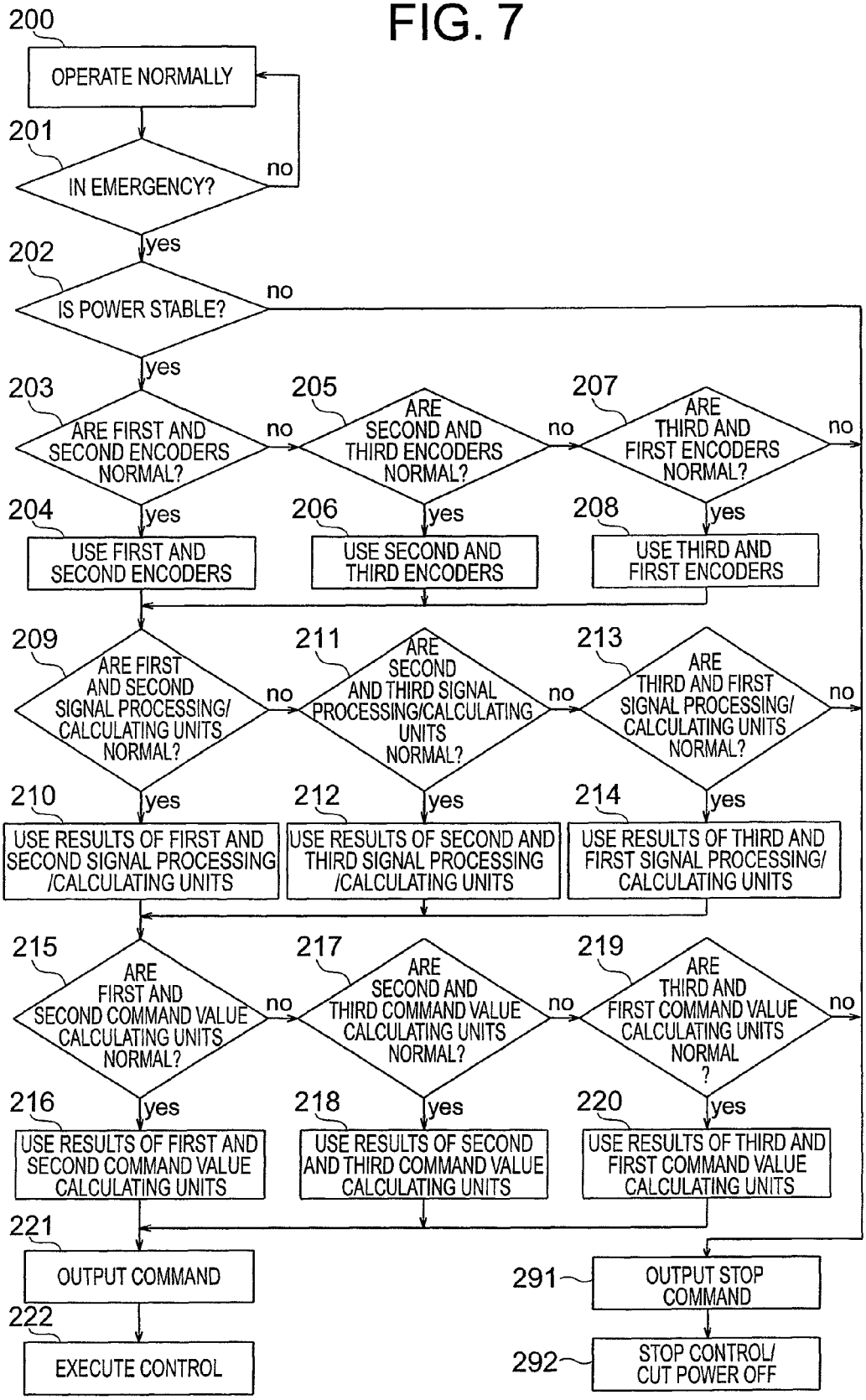
FIG. 7 A block diagram illustrating an operation of the brake controller of FIG. 5.

Next, an operation of the emergency stop system for an elevator according to this second embodiment will be described referring to the drawing. FIG. 7 is a flowchart illustrating an operation of the brake controller of the emergency stop system for an elevator according to the second embodiment of the present invention.

The operation of the brake controller in the determination of the emergency stop command (Step 201) and the determination of the safety of the power source (Step 202) is the same as the operation in the determination of the emergency stop command (Step 101 of FIG. 3) and in the determination of the safety of the power source (102 of FIG. 3) in the first embodiment.

The sensor signal processing unit 41 calculates the deceleration of the car based on the signals detected by the speed governor encoders 1, 2, and 3. The sensor signal processing unit 41 has the three-system signal processing/calculating units 51, 52, and 53, each independently performing a calculation. First, each of the signal processing/calculating units 51, 52, and 53 calculates the state quantity of the elevator, such as the deceleration based on the signals obtained from the speed governor encoders 1, 2, and 3. The results are compared in each of the calculating units to detect a malfunction of the encoder. In the comparison, when a difference between the state quantities calculated by using the encoder signals from each two-system is smaller than the predetermined value, or is less than the predetermined value (first predetermined value), it is determined that both encoders operate normally. When the difference is larger than the predetermined value, or is equal to or larger than the predetermined value (first predetermined value), it is determined that at least any one of the encoders malfunctions. By providing the three-system encoders, even when it is determined that one-system encoder malfunctions, the encoder signals from the remaining two-system encoders can be used to perform control (Steps 203 to 208).

When two-or-more-system encoders operate normally, the signals from the encoders which operate normally are used to calculate the necessary state quantities of the elevator in the signal processing/calculating units 51, 52, and 53. The results of the calculations are compared with each other to determine that the calculations in the signal processing/calculating units 51, 52, and 53 are correct. Even in this case, the comparison is performed between the results of the calculations of each two-system. When a difference between the calculated state quantities is smaller than the predetermined value, or is less than the predetermined value (second predetermined value), it is determined that the signal processing/calculating units both operate normally. When the difference is larger than the predetermined value, or is equal to or larger than the predetermined value (second predetermined value), it is determined that at least any one of the signal processing/calculating units malfunctions. By providing the three-system calculating units, even if it is determined that a one-system signal processing/calculating unit malfunctions, the results in the remaining two-system signal processing/calculating units can be used to perform the control (Steps 209 to 214).

As in the sensor signal processing unit 41, when three-system command value calculating units are provided and compared with each other to confirm that the two-system command value calculating units operate normally in the command calculating unit 42, only the results of processing in the command value processing units which operate normally can be used to perform the control even if a failure occurs in the remaining one-system command value calculating unit (Steps 215 to 220).

The sensor signal processing unit 41 outputs the state quantity of the elevator used for the control when two-or-more-system speed governor encoders of the speed governor encoders 1, 2, and 3 and two-or-more-system signal processing/calculating units of the signal processing/calculating units 51, 52, and 53 operate normally. The sensor signal processing unit 41 outputs the detection fail signal to the command calculating unit 42 when two-or-more-system speed governor encoders of the speed governor encoders 1, 2, and 3 or two-or-more-system signal processing/calculating units of the signal processing/calculating units 51, 52, and 53 malfunction.

Figure 8:
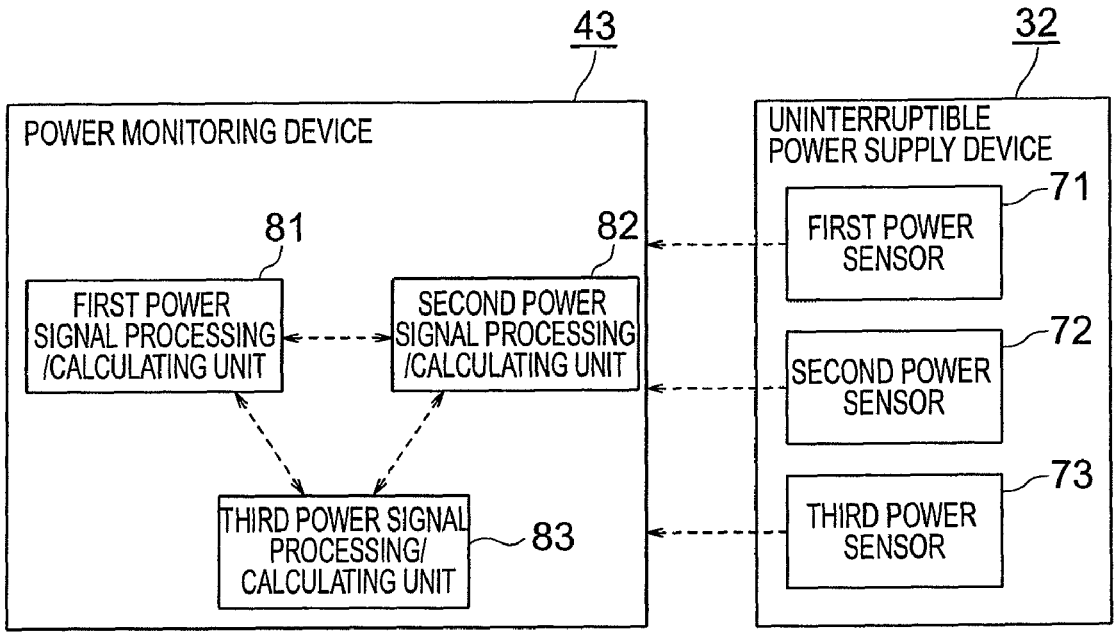
FIG. 8 A block diagram illustrating configurations of an uninterruptible power supply device and a power monitoring device of FIG. 6.

For the uninterrupted power source unit 32 and the power monitoring device 43, the following method may be used. Three-system power sensors 71, 72, and 73 and three-system power signal processing/calculating units 81, 82, and 83 are provided as illustrated in FIG. 8. By performing the detection and the calculation with this configuration, the uninterrupted power source unit 32 and the power monitoring device 43 operate in the same manner as in the case where no failure occurs even when a failure occurs in one of the sensors or the calculating units, as in the case of the sensor signal processing unit 41 in the second embodiment.

Further, when four-or-more-system sensors or calculating units are provided and compared with each other to confirm that two-or-more-system sensors or calculating units operate normally, a method of operating the command calculating unit 42 by using only the results of processing in the calculating units which operate normally may be used even if a failure occurs in two-or-more-system calculating units. As the number of systems for the sensor or the calculating unit to be used, any of a method of using three-or-more-system sensors or the calculating units as described in this second embodiment and a method of using two-system sensors or calculating units as described in the first embodiment above can be selected in accordance with the degree of reliability of the sensors and the calculating units and the degree of safety required for the system.

When three-or-more-system sensors or calculating units are provided, there is used a method of comparing the sensors or the calculating units to operate the elevator only when the three-or-more-system sensors or calculating units operate normally and to stop the operation when a failure occurs in a part of the sensors or the calculating units and only two-system sensors or calculating units operate normally to enable a safer operation. In this case, the brake is not forcibly stopped by the power shutoff without control as in the above-mentioned case where the electromagnetic brake is used, and the brake can be controlled at any time.

The case where the three-system sensors and the three-system calculating units are prepared and the results are compared to ensure the reliability has been described in this second embodiment, but two- or one-system state sensor(s) or calculating unit(s) is/are provided if the two- or one-system state sensor(s) or calculating unit(s) can ensure the reliability of the safety system. Accordingly, the cost can be reduced.

The invention claimed is:

1. An emergency stop system for an elevator, comprising:

a state sensor for detecting an operation of a car;

a brake device for braking the car;

a brake controller for outputting a signal for operating the brake device based on a signal detected by the state sensor; and an uninterruptible power supply device for supplying electric power to the state sensor, the brake device, and the brake controller, wherein:

the brake controller includes:

a signal processing/calculating unit for calculating deceleration of the car based on the signal detected by the state sensor, a command value calculating unit for calculating a command value for operating the brake device based on the deceleration of the car, which is calculated by the signal processing/calculating unit, and a power monitoring device for monitoring state of the uninterruptible power supply device; and at least one of the state sensor, the signal processing/calculating unit, and the command value calculating unit has a plurality of independent systems.

2. The emergency stop system for an elevator according to claim 1, wherein:

the state sensor includes two-system state sensors including:

a first state sensor for detecting the operation of the car, and a second state sensor for detecting the operation of the car;

the signal processing/calculating unit calculates the deceleration of the car based on a signal detected by the first state sensor and the deceleration of the car based on a signal detected by the second state sensor; and the brake controller performs brake control when a difference between (i) a result of calculation based on the signal detected by the first state sensor and (ii) a result of calculation based on the signal detected by the second state sensor is less than a first predetermined value, and stops the brake control when the difference is equal to or larger than the first predetermined value.

3. The emergency stop system for an elevator according to claim 1, wherein:

the signal processing/calculating unit includes two-system signal processing/calculating units including:

a first signal processing/calculating unit for calculating the deceleration of the car based on the signal detected by the state sensor, and a second signal processing/calculating unit for calculating the deceleration of the car based on the signal detected by the state sensor; and the brake controller performs brake control when a difference between (i) a result of calculation in the first signal processing/calculating unit and (ii) a result of calculation in the second signal processing/calculating unit is less than a first predetermined value, and stops the brake control when the difference is equal to or larger than the first predetermined value.

4. The emergency stop system for an elevator according to claim 1, wherein:

the command value calculating unit includes two-system command value calculating units including:

a first command value calculating unit for calculating a command value for operating the brake device based on the calculated deceleration of the car, and a second command value calculating unit for calculating a command value for operating the brake device based on the calculated deceleration of the car; and the brake controller performs brake control when a difference between (i) a result of calculation in the first command value calculating unit and (ii) a result of calculation in the second command value calculating unit is less than predetermined value, and stops the brake control when the difference is equal to or larger than the predetermined value.

5. The emergency stop system for an elevator according to claim 1, wherein:

the state sensor includes three-system state sensors including:

a first state sensor for detecting the operation of the car, a second state sensor for detecting the operation of the car, and a third state sensor for detecting the operation of the car;

the signal processing/calculating unit calculates the deceleration of the car based on a signal detected by the first state sensor, the deceleration of the car based on a signal detected by the second state sensor, and the deceleration of the car based on a signal detected by the third state sensor; and the brake controller performs brake control when any of (i) a difference between a result of calculation based on the signal detected by the first state sensor and a result of calculation based on the signal detected by the second state sensor, (ii) a difference between the result of calculation based on the signal detected by the second state sensor and a result of calculation based on the signal detected by the third state sensor, and (iii) a difference between the result of calculation based on the signal detected by the third state sensor and the result of calculation based on the signal detected by the first state sensor, is less than a first predetermined value, and stops the brake control when the differences are all equal to or larger than the first predetermined value.

6. The emergency stop system for an elevator according to claim 1, wherein:

the signal processing/calculating unit includes three-system signal processing/calculating units including:

a first signal processing/calculating unit for calculating the deceleration of the car based on the signal detected by the state sensor, a second signal processing/calculating unit for calculating the deceleration of the car based on the signal detected by the state sensor, and a third signal processing/calculating unit for calculating the deceleration of the car based on the signal detected by the state sensor; and the brake controller performs brake control when any of (i) a difference between a result of calculation in the first signal processing/calculating unit and a result of calculation in the second signal processing/calculating unit, (ii) a difference between the result of calculation in the second signal processing/calculating unit and a result of calculation in the third signal processing/calculating unit, and (iii) a difference between the result of calculation in the third signal processing/calculating unit and the result of calculation in the first signal processing/calculating unit, is less than a first predetermined value, and stops the brake control when the differences are all equal to or larger than the first predetermined value.

7. The emergency stop system for an elevator according to claim 1, wherein:

the command value calculating unit includes three-system command value calculating units including:

a first command value calculating unit for calculating the command value for operating the brake device based on the deceleration of the car, a second command value calculating unit for calculating the command value for operating the brake device based on the deceleration of the car, and a third command value calculating unit for calculating the command value for operating the brake device based on the deceleration of the car; and the brake controller performs brake control when any of (i) a difference between a result of calculation in the first command value calculating unit and a result of calculation in the second command value calculating unit, (ii) a difference between a result of calculation in the second command value calculating unit and the result of calculation in the third command value calculating unit, and (iii) a difference between a result of calculation in the third command value calculating unit and a result of calculation in the first command value calculating unit, is less than a predetermined value, and stops the brake control when the differences are all equal to or larger than the predetermined value.

8. The emergency stop system for an elevator according to claim 2, wherein:

the signal processing/calculating unit includes two-system signal processing/calculating units including:

a first signal processing/calculating unit for calculating the deceleration of the car based on the signal detected by the state sensor, and a second signal processing/calculating unit for calculating the deceleration of the car based on the signal detected by the state sensor; and the brake controller performs brake control when a difference between (i) a result of calculation in the first signal processing/calculating unit and (ii) a result of calculation in the second signal processing/calculating unit is less than a second predetermined value, and stops the brake control when the difference is equal to or larger than the second predetermined value.

9. The emergency stop system for an elevator according to claim 2, wherein:

the command value calculating unit includes two-system command value calculating units including:

a first command value calculating unit for calculating the command value for operating the brake device based on the calculated deceleration of the car, and a second command value calculating unit for calculating the command value for operating the brake device based on the calculated deceleration of the car; and the brake controller performs brake control when a difference between (i) a result of calculation in the first command value calculating unit and (ii) a result of calculation in the second command value calculating unit is less than a second predetermined value, and stops the brake control when the difference is equal to or larger than the second predetermined value.

10. The emergency stop system for an elevator according to claim 3, wherein:

the command value calculating unit includes two-system command value calculating units including:

a first command value calculating unit for calculating the command value for operating the brake device based on the calculated deceleration of the car, and a second command value calculating unit for calculating the command value for operating the brake device based on the calculated deceleration of the car; and the brake controller performs brake control when a difference between (i) a result of calculation in the first command value calculating unit and (ii) a result of calculation in the second command value calculating unit is less than a second predetermined value, and stops the brake control when the difference is equal to or larger than the second predetermined value.

11. The emergency stop system for an elevator according to claim 5, wherein:

the signal processing/calculating unit includes three-system signal processing/calculating units including:

a first signal processing/calculating unit for calculating the deceleration of the car based on the signal detected by the state sensor, a second signal processing/calculating unit for calculating the deceleration of the car based on the signal detected by the state sensor, and a third signal processing/calculating unit for calculating the deceleration of the car based on the signal detected by the state sensor; and the brake controller performs brake control when any of (i) a difference between a result of calculation in the first signal processing/calculating unit and a result of calculation in the second signal processing/calculating unit, (ii) a difference between the result of calculation in the second signal processing/calculating unit and a result of calculation in the third signal processing unit, and (iii) a difference between the result of calculation in the third signal processing/calculating unit and the result of calculation in the first signal processing/calculating unit, is less than a second predetermined value, and stops the brake control when the differences are all equal to or larger than the second predetermined value.

12. The emergency stop system for an elevator according to claim 5, wherein:

the command value calculating unit includes three-system command value calculating units including:

a first command value calculating unit for calculating the command value for operating the brake device based on the deceleration of the car, a second command value calculating unit for calculating the command value for operating the brake device based on the deceleration of the car, and a third command value calculating unit for calculating the command value for operating the brake device based on the deceleration of the car; and the brake controller performs brake control when any of (i) a difference between a result of calculation in the first command value calculating unit and a result of calculation in the second command value calculating unit, (ii) a difference between the result of calculation in the second command value calculating unit and a result of calculation in the third signal command value calculating unit, and (iii) a difference between the result of calculation in the third command value calculating unit and the result of calculation in the first command value calculating unit, is less than a second predetermined value, and stops the brake control when the differences are all equal to or larger than the second predetermined value.

13. The emergency stop system for an elevator according to claim 6, wherein:

the command value calculating unit includes three-system command value calculating units including:

a first command value calculating unit for calculating the command value for operating the brake device based on the deceleration of the car, a second command value calculating unit for calculating the command value for operating the brake device based on the deceleration of the car, and a third command value calculating unit for calculating the command value for operating the brake device based on the deceleration of the car; and the brake controller performs brake control when any of (i) a difference between a result of calculations in the first command value calculating unit and a result of calculations in the second command value calculating unit, (ii) a difference between the result of calculation in the second command value calculating unit and a result of calculation in the third signal command value calculating unit, and (iii) a difference between the result of calculation in the third command value calculating unit and the result of calculation in the first command value calculating unit, is less than a second predetermined value, and stops the brake control when the differences are all equal to or larger than the second predetermined value.

* * * * *